United States Patent [19]

Petrovic

[11] 4,168,064

[45] Sep. 18, 1979

[54] THUMB DRUM-PADDLE

[76] Inventor: Branislav Petrovic, 1540 E. Canfield Land Apt. 15, Anaheim, Calif. 92806

[21] Appl. No.: 906,239

[22] Filed: May 15, 1978

[51] Int. Cl.[2] ..... A63B 59/00; G10D 13/02

[52] U.S. Cl. ..... 273/67 R; 84/420

[58] Field of Search ..... 273/67 R, 67 B, 73 R, 273/76, 95 R; 84/411, 418, 420; 46/191

[56] References Cited

U.S. PATENT DOCUMENTS

| | | | |
|---|---|---|---|
| 1,536,255 | 5/1925 | Beal | 273/76 |
| 1,700,251 | 1/1929 | Contolini | 273/67 B |
| 2,515,715 | 7/1950 | Jones | 273/58 B X |
| 3,675,928 | 7/1972 | Gentile | 273/128 R |
| 3,802,009 | 4/1974 | Clemente | 273/67 B X |
| 3,924,856 | 12/1975 | Dekan et al. | 273/128 R |

FOREIGN PATENT DOCUMENTS

| | | | |
|---|---|---|---|
| 834280 | 5/1960 | United Kingdom | 273/76 |

*Primary Examiner*—Richard J. Apley

*Attorney, Agent, or Firm*—Raymond L. Madsen

[57] ABSTRACT

There is disclosed a hand held percussion toy comprising a pair of substantially parallel surfaces, each surface having a perimeter edge, the pair of substantially parallel surfaces being joined together by a third surface connected between the perimeter edges of the pair of parallel surfaces to form a sealed enclosure having an interior volume, the third surface having a recess therein extending into the interior volume, the recess being shaped to receive a thumb or a finger of a person for holding the percussion toy while maintaining the seal of the sealed enclosure whereby a drum-like structure is formed which produces a resonant tone when struck by another object.

9 Claims, 6 Drawing Figures

THUMB DRUM-PADDLE

The present invention relates to hand held percussion toys and games in which a ball other object is struck with a paddle, racket or the like and more particularly to toy drums and game paddles.

In the field of game paddles, bats or rackets, it has been the general practice to employ handles or hand grips by which the paddle, bat or racket may be grasped or held by a player. Although such devices have served the purpose, they have not proved entirely satisfactory under all conditions of service for the reasons that considerable difficulty has been experienced in obtaining a variety of holding or grasping positions for the player and difficulties encountered in reducing size and cost and simplifying construction.

Those concerned with the development of impact toys and game paddles have long recognized the need for a percussion toy or device which produces a pleasant resonant tone when struck by an object. The present invention fulfils this need.

One of the most critically problems confronting designers of impact toys and game implements has been to increase the versatility and utility of the game or toy components, which problem is overcome by the present invention.

The general purpose of this invention is to provide an impact toy which embraces all the advantages of similarly employed drums, paddles, rackets or bats and possess none of the afore described disadvantages. To attain this, the present invention contemplates a unique arrangements of surfaces forming a sealed enclosure with a recessed thumb hold whereby limited and restricted holding positions and limited utilities and application are avoided.

An object of the present invention is the provision of a game paddle which emits a pleasant resonant tone when it is struck by a ball or other object.

Another object is to provide a game paddle which is held and grasped by inserting the thumb of the player into a recess provided therefore.

A further object of the invention is the provision a percussion instrument of drum which maybe held by the thumb of one hand and struck with a stick or the mallet held by the other hand.

So another object of the invention is to provide a versatile toy which may be used as a racket, paddle or drum.

Other objects and many of the attendant advantages of this invention will be readily appreciated as the same becomes understood by reference to the following detailed description when considered in connection with the accompanying drawings with like reference numerals designate like parts throughout the figures thereof wherein.

Figure 1:
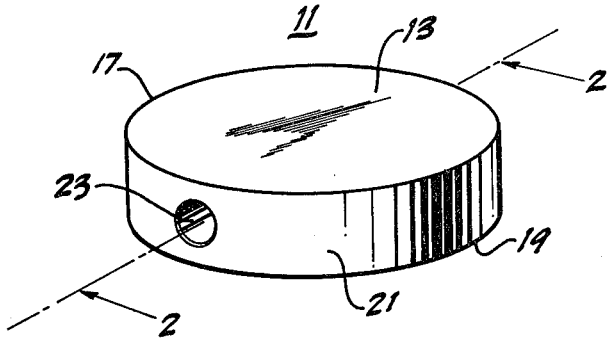
FIG. 1 shows a diagrammatic view, partly in top plan, of a preferred embodiment of the invention.

Referring now to the drawings, wherein like reference characters designate like or corresponding parts throughout the several views, there is shown in FIG. 1 (which illustrates a preferred embodiment) a percussion instrument or game paddle 11 having a pair of substantially parallel sides 13 and 15 of regular shape (side 15 not being visible) side 13 being substantially circular with a perimeter edge 17 therearound and side 15 being substantially circular with a perimeter edge 19 therearound. Perimeter edges 17 and 19 are connected and joined together by a surface 21 which is substantially cylindrical in shape. A substantially cylindrical recess or depression 23 in surface 21 protrudes or extends into the interior volume formed by sides 13, 15 and 21 and is adapted to receive the thumb or finger of a person. Recess 23 is also shaped and sealed to maintain the interior volume of device 11 in an water and air tight condition.

Figure 2:
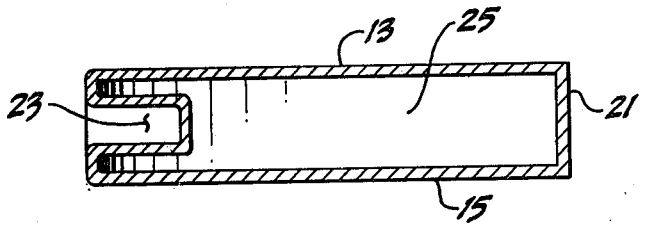
FIG. 2 illustrates a cross-section of the apparatus shown in FIG. 1 taken on a line 2—2 looking in the direction of the arrows.

In FIG. 2, which is a cross-section of the device illustrated in FIG. 1, the cross-section of recess 23 is substantially shown in rectangular form. Sides 13 and 15 are illustrated in a substantially parallel relationship; joined by side 21 to form an interior volume 25.

Figure 3A:
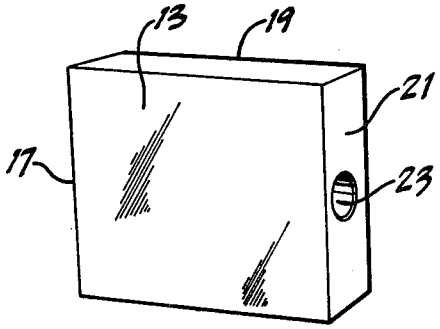
FIGS. 3A and 3B illustrates other polygonal shapes of the device.

FIG. 3A illustrates a regular shape in the form of a rectangular configuration of the device in which the perimeter edge 17 of side of 13 is in the shape of a rectangle as is edge 19 of said 15 (not illustrated). The device of FIG. 3A is a rectangular box in which recess 23 is centrally located in one of the sides formed by surface 21 joining edges 17 and 19.

Figure 3B:
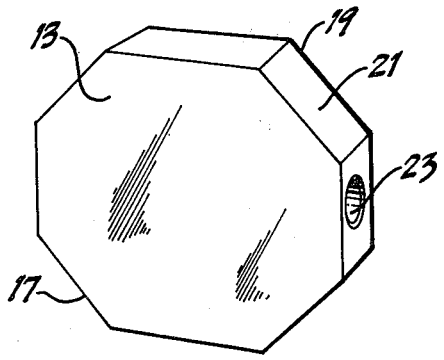

Turning now to FIG. 3B, there is illustrated a regular shape in the form of a hexagonal shaped device in which perimeter edges 17 and 19 are the edges of hexagonal surfaces and recess 23 is centrally located in one of the sides formed by surface 21 which joins edges 17 and 19.

Figure 4:
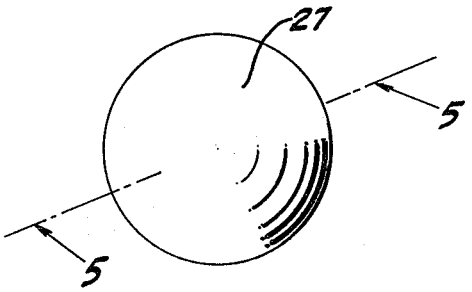
FIG. 4 shows a diagrammatic view of a ball used with the embodiments illustrated in FIGS. 1 through 3B.
Figure 5:
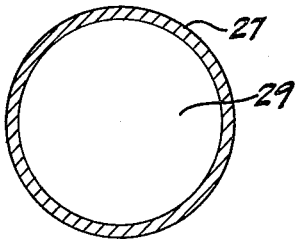
FIG. 5 illustrates a cross-section of the ball illustrated in FIG. 4 taken on the line 5—5 looking of the direction of the arrows.

FIGS. 4 and 5 show a ball which may be typically used with the paddle device of FIGS. 1 through 3B to play game using a paddle and ball. Ball 27 of FIG. 4 is shown in cross-section in FIG. 5 and has an interior hollow volume 29. Although illustrated as a hollow ball, the ball could be solid or made of a sponge type material depending upon the type of game that is played and the type of tone that is desired to be obtained from the paddle device 11 when the ball strikes surface 13 or 15.

It should be noted that the thumb held paddle or drum device 11 is water and air tight and be made from any material which is self supporting such as plastic, metal, or wood and alike. It should also be noted that although the device illustrated in FIGS. 1 through 3B is maybe made of inflexible material, device 11 may be made of a sheet of rubber or soft plastic such as vinyl plastic stretched over an interior wire support frame.

Operation of the invention may best be described by referring to FIGS. 1 and 2. When device 11 is used as a paddle, the player inserts his thumb into recess or hole 23 grasps either surface 13 or 15 with his fingers. A ball such as ball 27 of FIG. 4 may be bounced back and forth between players. Each time the ball bounces from paddle 11, it makes a resonant tone. The pitch of the tone can be changed by varying the size of the paddle, the larger the size, the lower the pitch of the tone produced.

One of the features of such a paddle is that it can be used on a beach, swimming pool, open fields, parks, and the like without the paddle being damaged by water, sand, dirt, mud or other undesirable elements. Further, the methods of playing the game can be varied to the imagination of the player. For example, the ball can be bounced over a net or into a basket.

A further use and utility of the paddle is as a percussion instrument such as a drum and therefore, the name drum-paddle is peculiarly descriptive. It can be used to learn to play a percussion instrument by holding the drum paddle by the thumb of one hand and striking it with a stick or mallet held in the other hand or by placing on a table and striking with sticks or mallets held in both hands.

Another feature of the present invention is that there are no handles or extentions which protrude from the drum-paddle which may cause injury to the player or user thereof. Also, the drum-paddle may be easily stored away since there are no handles or projections which require additional space.

It now should be apparent that the present invention provides a mechanical arrangement which may be employed in connection with a thumb held drum-paddle for playing games with a ball or using as a percussion instrument for producing pleasant resonant tones when struck by an object.

Although particular components, etc., have been discussed in connection with a specific embodiment of a drum-paddle constructed in accordance with the teachings of the present invention, others may be utilized. Furthermore, it will be understood that although an exemplary embodiment of the present invention has been disclosed and discussed, other applications and mechanical arrangements and configurations are possible and that the embodiments disclosed may be subjected to various changes, modifications and subsitutions without necessarily departing from the spirit of the invention.

What is claimed is:

1. A game paddle comprising a pair of substantially parallel surfaces of regular shape, each surface having a perimeter edge, said pair of substantially parallel surfaces being joined together by a third surface connected between the perimeter edges of said pair of parallel surfaces to form a sealed enclosure having an interior volume, said third surface having a recess therein extending into said interior volume, said recess being sealed and having a width and depth greater than the dimensions of the thumb of a person for receiving the thumb of a person to hold said paddle, said sealed enclosure and said interior volume emitting a resonant drum-like tone when struck by an object such as a ball.

2. The game paddle described in claim 1 wherein said substantially parallel surfaces are substantially circular in shape and said third surface is substantially cylindrical in shape.

3. The game paddle described in claim 1 wherein said recess in said third surface is substantially cylindrical in shape.

4. The game paddle described in claim 1 wherein said substantially parallel surfaces are of polygonal configuration.

5. The game paddle described in claim 1 further including a ball for striking with either of said substantially parallel surfaces, said paddle producing a resonant tone when struck by said ball.

6. A percussion instrument comprising a pair of substantially parallel surfaces of regular shape, each surface having a perimeter edge therealong, said pair of substantially parallel surfaces being joined together by a third surface connected between the perimeter edges of said pair of parallel surfaces to form a sealed enclosure having an interior volume, said third surface having a recess therein extending into said interior volume, said recess having a width and depth greater than the dimensions of the thumb of a person for receiving the thumb of a person for holding said percussion instrument while maintaining the sealed condition of said interior volume whereby a resonant tone is produced when struck by an object.

7. The percussion instrument described in claim 6 wherein said substantially parallel surfaces are substantially circular in shape and said third surface is substantially cylindrical in shape.

8. The percussion instrument described in claim 6 wherein said recess in said third surface is substantially cylindrical in shape.

9. The percussion instrument described in claim 6 wherein said substantially parallel surfaces are of polygonal configuration.

* * * * *